US010800642B2

(12) United States Patent
Braun

(10) Patent No.: US 10,800,642 B2
(45) Date of Patent: Oct. 13, 2020

(54) DEVICE FOR FILLING CONTAINERS WITH A FILLING PRODUCT

(71) Applicant: KRONES AG, Neutraubling (DE)

(72) Inventor: Franz Braun, Neutraubling (DE)

(73) Assignee: KRONES AG, Neutraubling (DE)

( * ) Notice: Subject to any disclaimer, the term of this patent is extended or adjusted under 35 U.S.C. 154(b) by 13 days.

(21) Appl. No.: 15/579,922

(22) PCT Filed: Oct. 31, 2016

(86) PCT No.: PCT/EP2016/076196

§ 371 (c)(1),
(2) Date: Dec. 5, 2017

(87) PCT Pub. No.: WO2017/072353

PCT Pub. Date: May 4, 2017

(65) Prior Publication Data

US 2018/0222738 A1 Aug. 9, 2018

(30) Foreign Application Priority Data

Oct. 30, 2015 (DE) ..... 10 2015 118 671

(51) Int. Cl.
*B67C 3/22* (2006.01)
*B67C 3/06* (2006.01)
*B67C 3/28* (2006.01)

(52) U.S. Cl.
CPC ..... *B67C 3/225* (2013.01); *B67C 3/06* (2013.01); *B67C 3/22* (2013.01); *B67C 3/28* (2013.01); *B67C 2003/228* (2013.01)

(58) Field of Classification Search
CPC .. B67C 3/225; B67C 3/28; B67C 3/06; B67C 3/22; B67C 2003/228
USPC ..... 141/144–146
See application file for complete search history.

(56) References Cited

U.S. PATENT DOCUMENTS 4,588,001 A * 5/1986 Leonard ..... B67C 3/004 141/145
6,810,927 B2 * 11/2004 Ronchi ..... B67C 3/208 141/144
7,464,732 B2 * 12/2008 Nishino ..... B67C 3/04 141/144

(Continued)

FOREIGN PATENT DOCUMENTS

DE 60309244 6/2007
DE 202009010813 12/2009

(Continued)

*Primary Examiner* — Marina A Tietjen
(74) *Attorney, Agent, or Firm* — Haynes and Boone, LLP

(57) ABSTRACT

A device for filling containers with a filling product, that includes a stationary plant section, a plant section, and a rotary distributor is described. The plant section rotates in relation to the stationary plant section and includes at least one filling valve for filling a container with the filling product. The rotary distributor is configured to transfer the filling product from the stationary plant section to the rotating plant section, and has a distributor housing and a distributor shaft, which is at least partially accommodated in the distributor housing and which includes at least one bore for conducting the filling product. The distributor housing is disposed on the stationary plant section and the distributor shaft is disposed on the rotating plant section.

17 Claims, 5 Drawing Sheets

(56) References Cited

U.S. PATENT DOCUMENTS

| | | | | |
|---|---|---|---|---|
| 7,699,080 | B2 * | 4/2010 | Burgmeier | B67C 3/22 141/236 |
| 8,151,831 | B2 * | 4/2012 | Zanini | B67C 3/22 141/144 |
| 8,857,478 | B2 * | 10/2014 | Klarl | B67C 3/22 141/144 |
| 2009/0223168 | A1 * | 9/2009 | Zanini | B67C 3/001 53/281 |
| 2012/0210673 | A1 * | 8/2012 | Schoenfelder | B67B 3/2033 53/111 R |

FOREIGN PATENT DOCUMENTS

| | | |
|---|---|---|
| DE | 102012109884 | 4/2014 |
| DE | 102013102594 | 9/2014 |
| EP | 0893396 | 1/1999 |
| EP | 1468959 | 10/2004 |
| EP | 2279952 | 2/2011 |
| EP | 2368835 | 9/2011 |
| JP | 2000255691 | 9/2000 |

* cited by examiner

DEVICE FOR FILLING CONTAINERS WITH A FILLING PRODUCT

CROSS REFERENCE TO RELATED APPLICATIONS

This application is a national stage of International Application No. PCT/EP2016/076196, filed Oct. 31, 2016, which claims priority from German Patent Application No. 10 2015 118 671.3 filed on Oct. 30, 2015 in the German Patent and Trademark Office, the disclosures of which are incorporated herein by reference in their entirety.

BACKGROUND

Technical Field

The present invention relates to a device for filling a container with a filling product, and in particular relates to a rotary filler for filling bottles or cans in a beverage filling plant.

Related Art

From the state of the art, it is known to fill bottles and cans in beverage filling plants by means of rotary fillers, in which a plurality of filling elements are arranged on the circumference of a filler carousel, which is provided for introducing the filling product into each of the containers that are to be filled. During the filling process, the containers to be filled are each retained below the applicable filling element, and thus rotate together with the filling elements on the filler carousel.

It is known to provide a rotary distributor in order to transfer the filling product from a stationary section of the plant to the rotating section of the plant, i.e. the filler carousel, and also in order to transfer operating media, such as for example pre-pressurizing gas or pneumatic or hydraulic media, to the filler carousel. In this context, it is known from the state of the art to provide on the stationary section of the plant a stationary shaft, wherein, by means of bores or lines within this shaft, the applicable media and the filling product can be introduced from below into the distributor shaft. On the rotating section of the plant, i.e. the filler carousel, a distributor housing is provided, which is fitted on the distributor shaft, and which together with the distributor shaft forms annular channels. Connected with the annular channels of the distributor housing, and pointing radially outwards, are supply lines, which convey the filling product to a filling product bowl, for example a ring bowl or a central bowl, of the filling product carousel. The filling elements then draw the filling product from this ring bowl or central bowl. Additionally, the other media, for example control media or pressure gas, are fed from below through the stationary distributor shaft to the distributor housing, then conveyed via suitable supply lines to annular channels, from which each of the filling valves draws the media. Thus the distributor shaft is stationary, and the distributor housing, along with the supply lines to the applicable ring bowl or central bowl and the filling valves, rotate relative to the stationary sections of the plant and also relative to the distributor shaft.

In order to meet the applicable hygiene requirements, devices for filling containers with filling products are regularly provided in isolator housings, in which an atmosphere that meets the hygiene requirements can be maintained. Depending on the filling product that is to be filled, the main concern can be either microbiological purity or a low oxygen content. A combination of requirements for a low oxygen content and an aseptic atmosphere can also be met in this manner in the isolator housing.

The sealing between the rotating section of the plant, i.e. for example the filler carousel, and the stationary section, takes place for example by means of surge chambers. In these, a circumferential trough, which can be filled with water, is provided on the stationary section. On the rotating section, a rotating blade is provided, whose dimensions are such that it dips into the water that is introduced into the trough. By this means an exchange of gas with the surroundings can be prevented, and an interior space which is substantially sealed against the environment can be provided, with the result that a reliable rotational seal can be achieved.

SUMMARY

A device for filling containers with a filling product that enables a more compact design is described.

A device for filling containers with a filling product is described that includes a stationary plant section and a plant section that rotates in relation to the stationary plant section and on which at least one filling valve for filling a container to be filled with the filling product is disposed. The device further includes a rotary distributor for transferring the filling product and/or a medium from the stationary plant section to the rotating plant section, wherein the rotary distributor has a distributor housing and a distributor shaft which is at least partially accommodated therein, and which includes at least one bore for conducting the filling product and/or the medium. The distributor housing is disposed on the stationary plant section and the distributor shaft is disposed on the rotating plant section.

Due to the fact that the distributor housing is disposed on the stationary plant section and the distributor shaft is disposed on the rotating plant section, it is possible for the rotating plant section to be designed in a more compact manner. In particular, this design makes it possible for both a supply of filling product and the supply of media to take place from above the filler carousel. By this means it is possible to dispense with the supply lines known from the state of the art, which extend radially outwards from the rotating distributor housing to the ring bowl. This accordingly results in a more compact design below the proposed stationary distributor housing. In particular, the filling product bowl can be disposed in a position which enables easier access for maintenance purposes.

The filling product bowl for supplying and providing the filling product during filling operation can thus also be provided independently of the rotating section of the plant, in an advantageous position, in particular also eccentrically or uncommonly to the axis of rotation of the filler carousel. Because a ring bowl for the filling product on the filler carousel is dispensed with, there is a reduction in the rotating mass, and thereby also in the moment of inertia, with the result that less strength is required in the designs of the bearing for mounting the filler carousel and the drive for driving the filler carousel.

Furthermore, due to the location of the distributor shaft on the rotating section of the plant, it is possible to dispose of the filling product lines for supplying the filling product to the filling valves, as well as the medium lines, on the lower end face of the distributor shaft, again enabling a more compact design of the rotating section to be achieved than was possible in the conventional designs of filler carousels, in which a radial connection of the supply lines to the filling valves and/or to the ring bowl was provided. Accordingly, the entire rotating section in the area of the transfer or supply of the filling product and other media can be designed in a more compact form.

The result is both a more compact overall design and increased flexibility in the design of the individual components of the plant, so that the footprint of the device for filling containers with a filling product as a whole can be reduced or adapted to the available space.

On the lower end face of the distributor shaft facing the rotating section, the filling valves are generally individually connected with filling valve supply lines. In various embodiments, on the lower end face of the distributor shaft a connection is provided to at least one filling valve via a filling product line, wherein the connection of the filling product line is typically oriented in the direction of the axis of rotation of the distributor shaft. By means of the connection on the lower end face, a compact design of the connection of the filling valves can be achieved, since the applicable lines can be routed in the direction of the axis of rotation.

On the lower end face of the distributor shaft, a distributor plate is advantageously disposed, in which at least one distribution chamber is defined, to which at least one filling product line and/or medium line is attached. By means of the provision of the distributor channels in the distributor plate, an area can be provided that is sufficient to enable the connection of all desired filling product and medium lines in the direction of the axis of rotation.

In an advantageous further embodiment, in the end face of the distributor housing a connection for the filling product is provided, which discharges into a distribution space which is disposed between the upper end face of the distributor shaft and the distributor housing, and is in communication with a bore of the distributor shaft. By means of the distribution space provided on the end face, an even more compact design can be provided, since it is possible to dispense with the provision of at least one further annular channel between the distributor housing and the distributor shaft, since the transfer of the applicable medium takes place via the end face.

Each filling valve is, in various embodiments, connected to the distributor shaft via a separate filling product line. By means of the individual connection of each filling valve to the distributor shaft, it is possible to dispense with the provision of a ring bowl in the rotating section, so that the rotating section and the deployment of the filling valves can also be designed as a whole to be more compact and with a lower mass. In each of the individual supply lines, it is also possible to dispose, for example, a flow meter or other sensors, enabling individual control of the filling product supply to each filling valve, and making it possible thereby to achieve improved control of the plant.

Furthermore, there is a reduction in the rotating mass, and thereby also in the moment of inertia, of the rotating section as a whole, with the result that the plant as a whole can have a more efficient design and, for example, the dimensions of bearings and mounts can be reduced.

On the end face of the distributor shaft, a distributor plate is generally disposed, via which each of the filling valves is connected to the distributor shaft. The distributor plate accordingly rotates together with the rotating distributor shaft. In particular, distributor channels are provided in the distributor plate, via which each medium that is dispensed from the distributor shaft, for example the filling product or filling product components, can be transferred to the applicable receiving points, in particular the receiving points that are provided by means of the individual connecting lines.

In particular, in addition to the annular channels that are defined by the distributor shaft and the distributor housing, a central feed of medium is provided through the distributor housing to the distributor shaft, said central feed of medium being introduced substantially axially to the distributor shaft, through the distributor housing, into a receiving area defined between the distributor shaft and the distributor housing, and then guided through a suitable bore that is provided in the distributor shaft on the end face of the distributor shaft, and a distribution chamber in the distributor plate that is provided on the end face. The bore through the distributor shaft generally extends laterally and radially out of the distributor shaft, in order then to feed into the distribution chamber on the end face.

In various embodiments, a filling product bowl is provided, which is disposed on the stationary section of the plant above the rotary distributor and eccentrically or uncommonly to it, and the filling product is conveyed to a connection in the distributor housing via a filling product pipework system. Because the position of the filling product bowl can be freely chosen, it is possible to react flexibly to the construction requirements that apply.

For transfer of the other media, for example the first medium or the second medium, at least one medium line may form a fluid communication between a bore provided in the distributor shaft and a ring line provided in the rotating section of the plant.

Furthermore, a device for filling containers is described that includes an isolator housing, which includes a stationary isolator wall and an isolator wall that rotates relative thereto, wherein the isolator housing accommodates a device for treating containers in a beverage filling plant. An overflow gap is formed between the stationary isolator wall and the rotating isolator wall, and a positive pressure can be provided in the isolator housing.

Accordingly, sealing is provided between the rotating isolator wall and the stationary isolator wall by means of the overflow gap, which, due to a positive pressure applied in the isolator housing, makes it possible to prevent the entry of foreign bodies into the isolator housing.

Height adjustment is enabled if the rotating isolator wall is displaceable relative to the stationary isolator wall along an axis of rotation of the rotating isolator wall, and the width of the overflow gap is held substantially constant.

BRIEF DESCRIPTION OF THE FIGURES

Further embodiments and aspects of the present invention are more fully explained by the description below of the figures.

DETAILED DESCRIPTION

Examples of embodiments are described below with the aid of the figures. In the figures, elements which are identical or similar, or have identical effects, are designated with identical reference signs. In order to avoid redundancy, repeated description of these elements is in part dispensed with in the description below.

Figure 1:
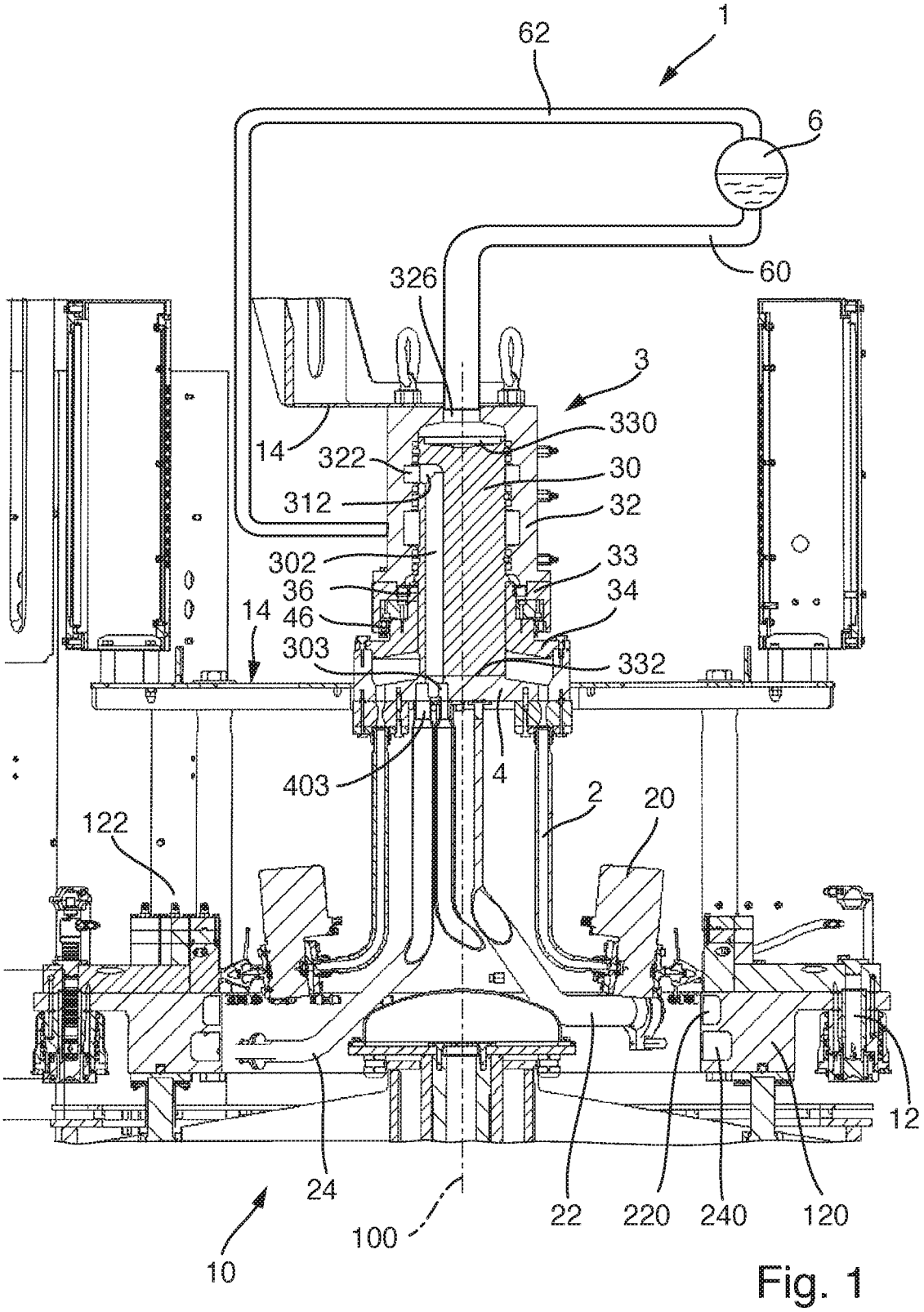
FIG. 1 is a schematic, partially sectional, perspective representation of a device for filling containers comprising a rotary distributor.

FIG. 1 shows schematically a device 1 for filling containers in a partially sectional perspective representation. The device 1 comprises a filler carousel 10, on whose circumference a plurality of filling valves 12, by means of which the filling of containers to be filled is carried out, are retained on a filling valve carrier 120. The containers to be filled are not shown here.

During operation, the filler carousel 10 rotates relative to a stationary plant section 14, upon which the filler carousel 10 is mounted. In FIG. 1 a torque support, below which the filler carousel 10 rotates, is shown as a part of the stationary plant section 14 by way of example.

The rotation of the filler carousel 10 during filling operation has the effect that containers to be filled are transported to positions beneath each filling valve 12. The interiors of the containers may be rinsed with a rinsing gas. The containers are then pre-pressurized with a pressure gas, and then filled with the filling product. The design of a filler carousel 10 with the filling valves 12 arranged on it is known in principle.

A rotary distributor 3 is provided in order to transfer the filling product and additional media, such as for example a first medium in the form of a rinsing gas or pressure gas, or a second medium in the form of control air, from the stationary plant section 14 to the rotating plant section in the form of the filler carousel 10.

The rotary distributor 3 has a distributor shaft 30 and a distributor housing 32. The distributor housing 32 is fixedly connected with the stationary plant section 14, and does not rotate during filling operation. The distributor shaft 30 is connected with the filler carousel 10, i.e. with the rotating plant section, and thus rotates together with the filler carousel 10 during filling operation. The rotary distributor 3 is also described in detail below with reference to FIGS. 2-4.

The filling valves 12 of the filler carousel 10 are connected via filling product lines 2 with the rotary distributor 3, in order to enable the filling product to be supplied to each of the filling valves 12. In each of the filling product lines 2, which run from the rotary distributor 3 to the filling valves 12, a flow meter 20 is provided, by means of which the flow of filling product from the rotary distributor 3 to the filling valve 12 can be measured and accordingly monitored. In the example embodiment that is shown, every filling valve 12 is connected with the rotary distributor 3 by a separate filling product line 2, and a flow meter 20 is disposed in every filling product line 2. This enables precise monitoring and control of the quantity of filling product that is dispensed by every filling valve 12. In alternative embodiments, only selected filling product lines 2 are provided with flow meters 20, and from this the filling product flows of those filling product lines 2 that are not equipped with flow meters 20 is determined approximately.

In addition to the filling product lines 2, medium lines 22 and 24 are provided, in order to transfer additional media to the filler carousel 10. A first medium, for example the pressure gas, is supplied by means of the medium line 22, and a second medium, for example control air or compressed air, is supplied by means of the medium line 24. The medium lines 22, 24 each discharge into a ring line 220, 240. The ring lines 220, 240 are incorporated in the filling valve carrier 120 of the filler carousel 10, and have supply lines to each of the filling valves 12. Thus by means of a reduced number of medium lines 22, 24, for example by means of only a single medium line 22, 24, the applicable medium, for example pressure gas as a first medium or control air as a second medium, can be transferred by means of the ring lines 220, 240 to each of the filling valves 12, or to the units that control them via schematically represented valve blocks 122, wherein the transfer of each medium to the filler valves 12 then takes place by means of the ring lines 220, 240.

The design of the rotary distributor 3 will now be described with reference to FIGS. 1-4.

As already mentioned, the rotary distributor 3 comprises a distributor housing 32, which is fixedly connected with the stationary plant section 14, and a distributor shaft 30, which is fixedly connected with the rotating plant section, i.e. with the filler carousel 10. During operation, the distributor shaft 30 thus rotates together with the filler carousel 10 in the distributor housing 32. On the distributor shaft 30 a distributor plate 4 is provided, to which are attached the filling product lines 2 and medium lines 22, 24 that were described above. The distributor plate 4 rotates together with the distributor shaft 30.

The distributor shaft 30 is mounted on the distributor housing 32 by means of a bearing 38, which is supported on a sealing element 34 of the distributor shaft 30 and on a bearing ring 33 of the distributor housing 32. The sealing element 34 is annular in form, and is pressed onto the distributor shaft 30, with which it forms a material-locked connection. The bearing ring 33 is fixedly attached to the distributor housing 32 by means of bolts.

The transition from the stationary section to the rotating section thus runs through the bearing 38, wherein on the stationary side the transition is to the bearing ring 33, and on the rotating side the transition is to the sealing element 34.

In order to form a sealed bearing chamber for accommodating the bearing 38, a shaft sealing ring 36, which seals the sealing element 34 against the distributor housing 32, is retained on the sealing element 34. A further shaft sealing ring 46 is retained on the bearing ring 33, and seals the bearing ring 33 against the sealing element 34. Between the two shaft sealing rings 36, 46, a sealed bearing chamber is formed, which prevents grease from the bearing 38 from entering the surroundings, and prevents cleaning medium from attacking the bearing 38.

Between the distributor housing 32 and the components that rotate together with the distributor shaft 30, there is a separation line indicated by reference sign 44. At this separation line the distributor housing 32 can be removed in an upwards direction for maintenance purposes, for example in order to replace the shaft sealing ring 36.

A further separation line is at reference sign 48. At this separation line 48, it is again possible to lift off the distributor housing 32 together with the distributor shaft 30 and the sealing element 34 for maintenance purposes, for example to replace the bearing or seals.

Bores 302, 304, 306 are provided in the distributor shaft 30, extending substantially in the direction of the axis of rotation 100 of the distributor shaft 30. Bores 302 and 304 serve to transfer the above-mentioned media, i.e. in particular the first medium and the second medium, to the filler carousel 10. Bore 306 is provided in order to transfer the filling product to the filler carousel 10.

Figure 2:
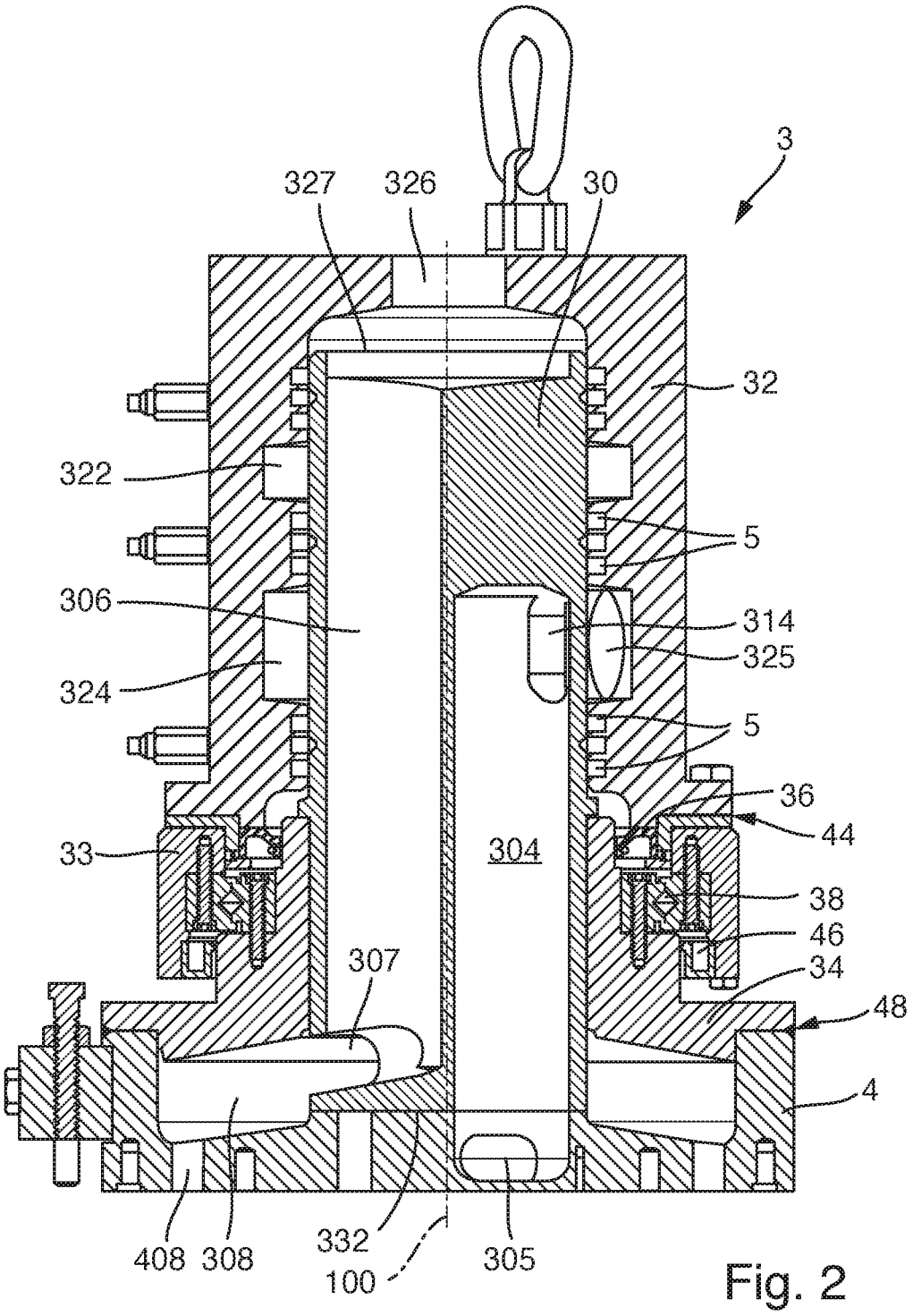
FIG. 2 is a schematic sectional representation through the rotary distributor from FIG. 1.

As can be seen from FIG. 2, bore 306 is provided in the distributor shaft 30 such that it first extends downwards from the upper end face 330 of the distributor shaft 30, and is then routed radially out of the distributor shaft 30 in a lateral direction via a lateral outlet bore 307. The filling product, which is conveyed through the bore 306, enters the distributor housing 32 from the end face of the distributor housing 32, through a connection 326 for the filling product, and flows into a distribution space 327 that is formed between the upper end face 330 of the distribution shaft 30 and the distributor housing 32. From this distribution space 327, the filling product flows via the bore 306 and the outlet bore 307 into a distribution chamber 308.

The geometry of the distribution space 327 is such that rising air bubbles are not trapped, but can instead be guided out via the connection 326. Thus there are no undercuts behind which air bubbles could be trapped, and the upper portion of the distribution space 327 slopes slightly upwards to the connection 326, such that air can thereby escape.

In the distribution shaft 30, there is typically only one bore for each medium. As a result, there is a defined path for each medium, and the individual bores 302, 304, 306 or paths for each medium can be specifically cleaned.

In the distributor housing 32, there is again generally only one connecting bore for each medium, and accordingly only one medium pipework system, which again reduces the expense of connecting and putting into operation a device according to the invention.

In the example embodiment that is shown, the distribution chamber 308 is formed between the distributor plate 4, which is disposed on the lower end face 332 of the distributor shaft 30, and a sealing element 34 of the distributor housing 32. In the distributor plate 4 there are bores 408, to each of which a filling product line 2 can be connected. The bores 408 in the distributor plate 4 are arranged in the direction of the axis of rotation 100 of the filler carousel 10.

The bores 408, for connecting the individual filling product lines 2 are provided at the furthest radius of all of the connections. The connections for the filling product lines are thus disposed radially to the outside, and the connections for the medium lines 22, 24 radially to the inside. In this manner a compact design can be achieved, which however at the same time enables the individual connection of each filling valve 12 via its own filling product line 2.

The design of the distribution chamber 308 thus enables the connection of all filling valves 12 via individual filling product lines 2, by means of their connection to the applicable bores 408 in the distributor plate 4. As can be seen in FIG. 1, each connection of the filling product lines 2 is in a direction parallel to the axial direction of the distributor shaft 30.

Figure 3:
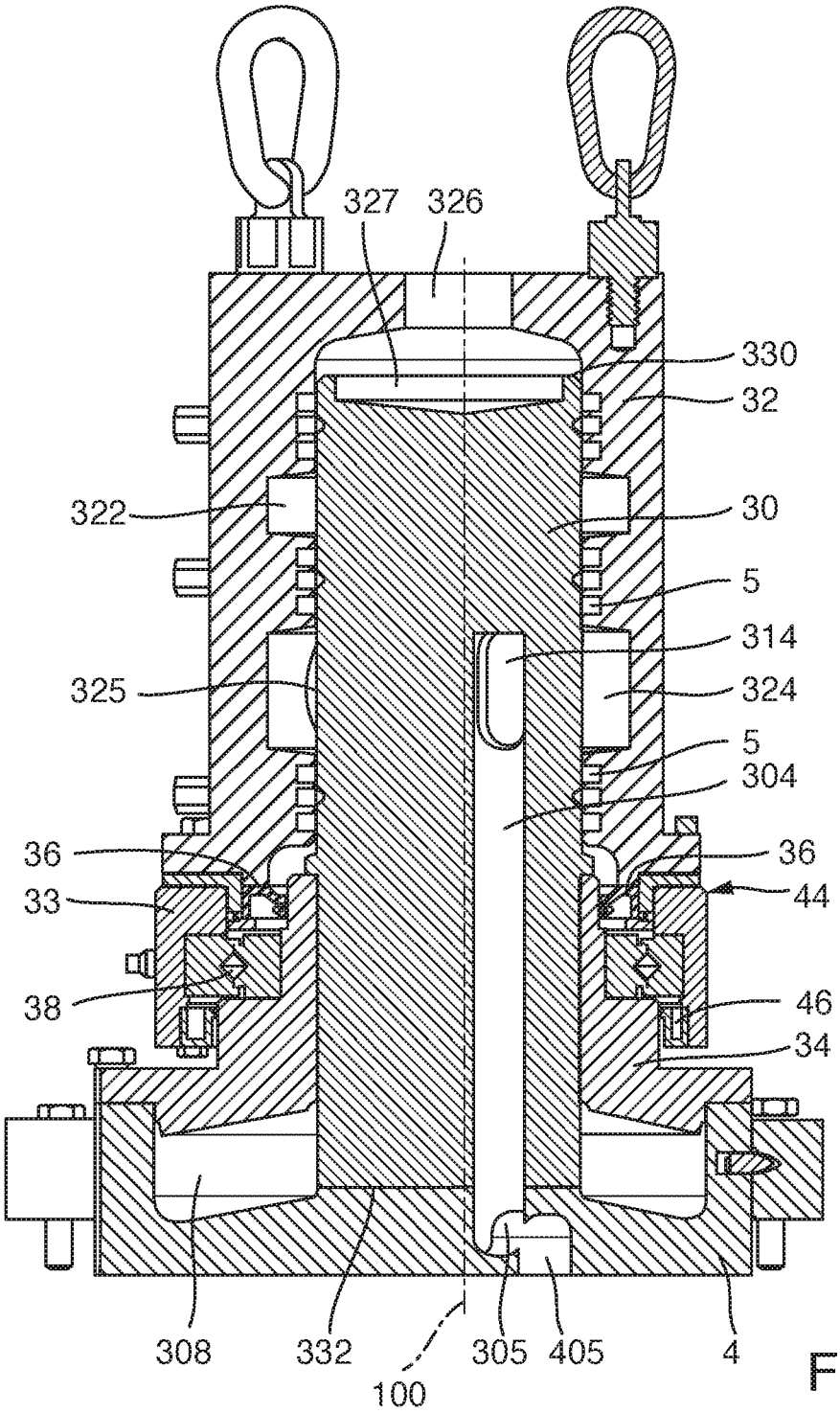
FIG. 3 is a schematic sectional representation through the rotary distributor of FIGS. 1 and 2.
Figure 4:
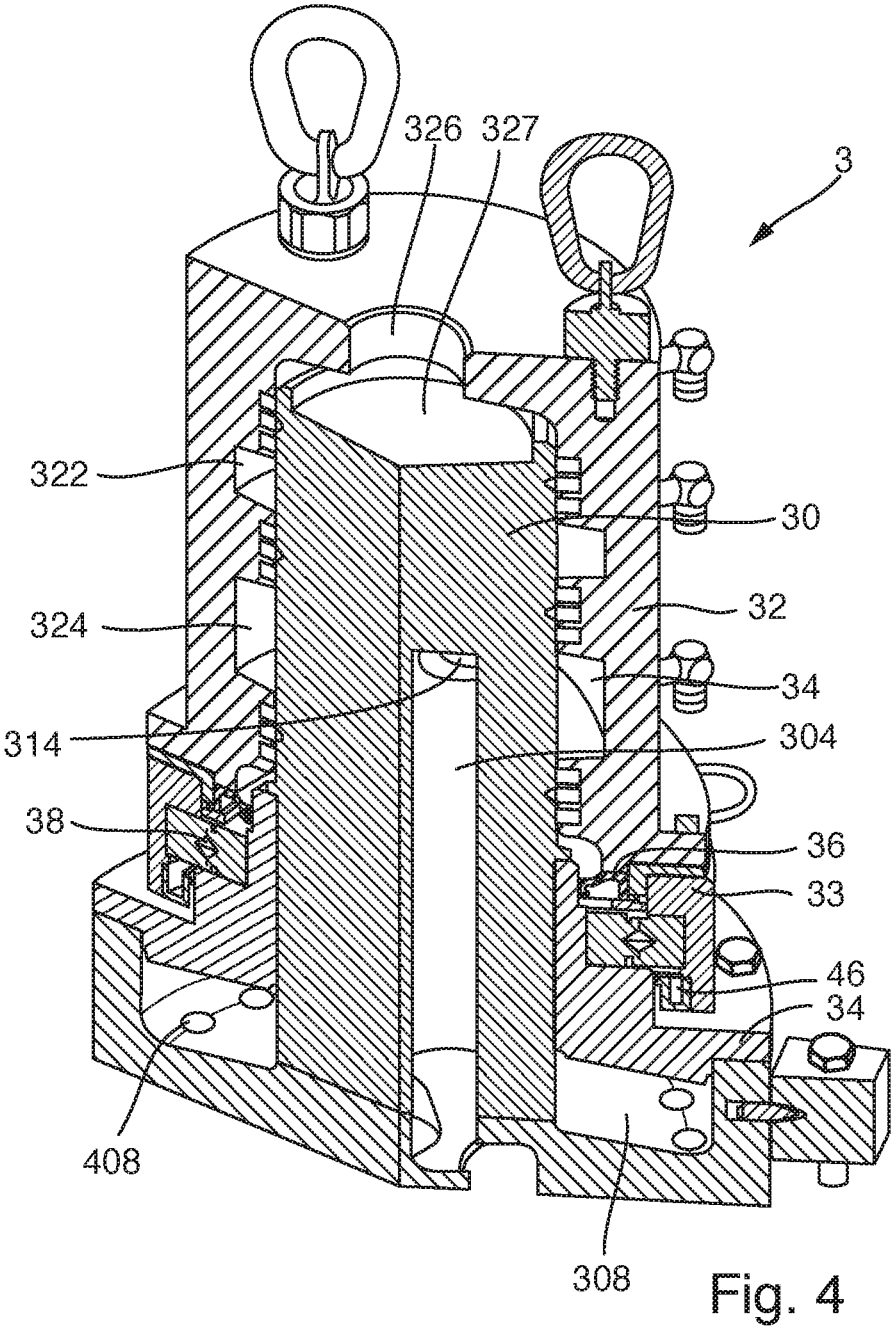
FIG. 4 is a schematic, partially sectional, perspective representation of the rotary distributor from the previous figures.

The media, which are for example conveyed through the bore 304 in the distributor shaft 30, enter a distribution chamber 305 disposed in the distributor plate 4 on the lower end face 332 of the distributor shaft 30, as can be seen for example in FIG. 3. By means of an axial bore 405 in the distributor plate 4, it is possible to supply the media, and in particular the first medium, to the filling valves 12, or to the ring line 220, by means of the medium line 22.

Between the distributor housing 32 and the distributor shaft 30 an annular channel 324 is formed. This is formed in the inner circumference of the distributor housing 32, and is sealed in the upwards and downwards directions by seals 5 disposed above and below the annular channel 324. The annular channel 324 is in communication with the bore 304 via a radial aperture 314 in the distributor shaft 30. The annular channel 324 is typically designed such that air in the upper portion of the annular channel can easily be guided out, and no fluids can persist in the lower portion.

Via a connection 325 in the distributor housing 32, the applicable medium can be introduced from outside into the annular channel 324. Accordingly, the medium introduced via the connection 325 enters the annular channel 324, and is then introduced via the radial aperture 314 into the bore 304, via which it is then introduced into the distribution chamber 305, in order then to be conveyed via the bore 305 into the medium line 22. The medium line 22 then supplies the medium to the ring line 220 on the filler carousel 10.

The same principle applies to the bore 302, as is indicated for example in FIG. 1. Here too, an annular channel 322 is formed in the inner circumference of the distributor housing 32, between the distributor housing 32 and the distributor shaft 30, and sealed in the upwards and downwards directions by means of seals 5. The annular channel 322 is connected with the bore 302 via a radial aperture 312 in the distributor shaft 30. The bore 302 discharges via the lower end face 332 of the distributor shaft 30 into a distribution chamber 303, which is connected with the medium line 24 via a bore 403. The medium line 24 is attached to the ring line 240, and can thereby supply the second medium to the individual filling valves 12.

Accordingly, in the rotary distributor 3 the distributor housing 32 is arranged to be stationary and non-rotatable with respect to the stationary plant sections 14 of the device 1, and the distributor shaft 30, together with the distributor plate 4 and the sealing element 34, rotates with the filler carousel 10.

Connection of each of the filling product lines 2 with the rotary distributor 3 is achieved in that the filling product lines 2 are attached to the distributor plate 4 in the direction of the axis of rotation 100 of the distributor shaft 30, and then routed to the individual filling valves 12. The supply of further media, for example compressed air or pressure gas, is achieved by means of the connection of the applicable medium lines 22, 24 to the distributor plate 4, wherein this connection too is provided in the direction of the axis of rotation 100 of the distributor shaft 30.

The upper portion of the filler, which in the example embodiments that are shown is formed, by way of example, by the stationary plant section 14 in the form of a platform, is generally adjustable in height. The pivot joint connectors that are needed to adjust the height are in part integrated in the stationary distributor housing 32.

The filling product is supplied via a filling product bowl 6, which can be in any position, but is typically disposed above the rotary distributor 3 and to its side. Via a suitable filling product pipework system 60, the filling product bowl 6 can then be connected to the connection 326 on the distributor housing 32. The filling product is accordingly fed from above to the rotary distributor 3 from the filling product bowl 6 via the filling product pipework system 60. A medium pipework system 62 can also lead to the rotary distributor 3, discharging in this case radially into the distributor housing 32 at the position at which the connection 325 is provided.

By this means it is possible to supply the filling product, the first medium and also the second medium from above. It is not necessary to specify a position for the filling product bowl 6, which can be disposed in a freely chosen position which is advantageous for the applicable design. The filler carousel 10 thus does not include the filling product bowl 6, with the result that the filler carousel 10 as a whole has a reduced mass and thereby also a reduced moment of inertia. Accordingly, the drives and the mounting of the filler carousel 10 can have a correspondingly simpler design by comparison with the conventional designs.

Figure 5:
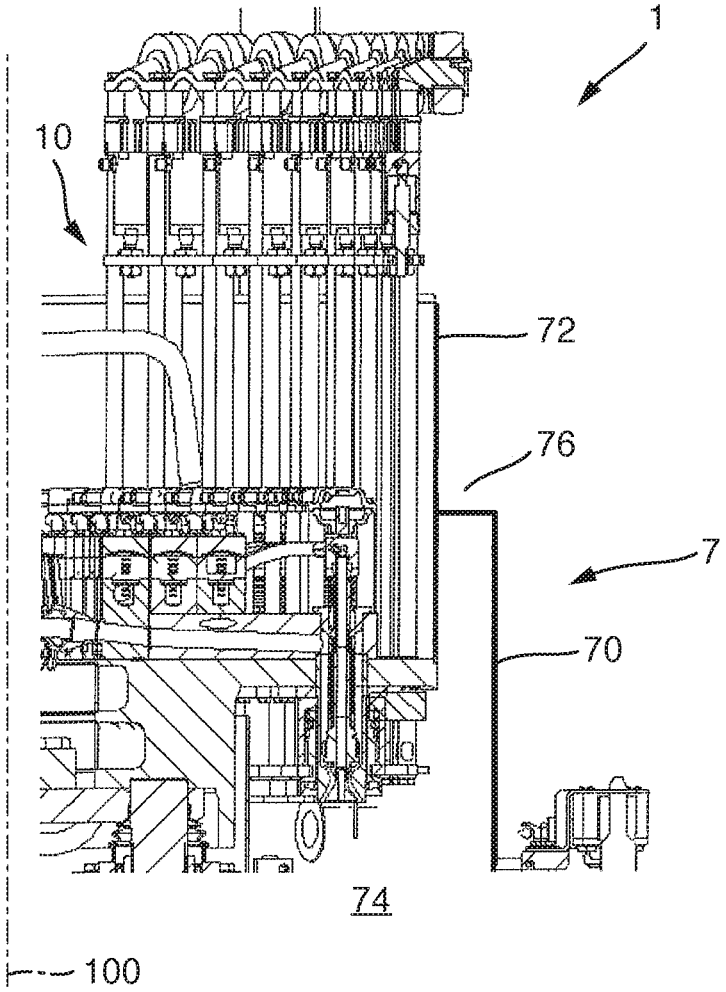
FIG. 5 is a schematic representation of the design of a seal between a rotating part and a stationary part.

FIG. 5 shows schematically the design of a further device 1 for filling containers. The design of the filler in this case can deviate from that described above. The filler rotates about the axis of rotation 100.

An isolator housing 7 is provided, which is defined by a first stationary isolator wall 70, which corresponds to a stationary plant section, in combination with a rotating isolator wall 72. The rotating isolator wall 72 rotates together with the filler carousel 10, which however in this case can have a different design from that of the previous example embodiments. The stationary isolator wall 70 and the rotating isolator wall 72 together form an isolator chamber 74.

In order to achieve a sealing of the rotating section against the stationary section, and in particular a sealing of the stationary isolator wall 70 against the rotating isolator wall 72, and at the same time to enable the sealing to be low-drag and reliable, an overflow gap 76 which serves as a seal is provided between the stationary isolator wall 70 and the rotating isolator wall 72. The sealing is achieved in that a positive pressure is provided in the isolator chamber 74, by means of which a constant overflow of gas is achieved from the isolator chamber 74 into the surroundings, via the overflow gap 76. By means of the constant escape of gas from the overflow gap 76, foreign bodies and foreign gases are prevented from penetrating through the overflow gap 76 from outside into the isolator chamber 74.

It is however also conceivable to suck ambient air from outside into the interior through the constant overflow gap. This is above all expedient as part of a cleaning process, in order to avoid the escape of cleaning medium aerosols, and thereby to avoid reaching the maximum allowable concentration for staff.

By means of the formation of a suitable overlap between the stationary isolator wall 70 and the rotating isolator wall 72 in the direction of the axis of rotation 100, it can further be achieved that the sealing effect of the overflow gap 76 is maintained when the height of the filler carousel 10 is adjusted. In this case, the dimensions of the gap are particularly preferably held constant independently of the height position of the filler carousel 10, over the entire range of its height adjustment.

To the extent applicable, all individual features described in the individual example embodiments can be combined with each other and/or exchanged, without departing from the field of the invention.

The invention claimed is:

1. A device for filling containers with a filling product, comprising:

a stationary plant section;

a rotating plant section that rotates in relation to the stationary plant section, and that comprises at least one filling valve;

a rotary distributor configured to transfer the filling product and/or a medium from the stationary plant section to the rotating plant section;

wherein the rotary distributor comprises:

a distributor housing disposed on the stationary plant section, and a distributor shaft disposed on the rotating plant section that is at least partially accommodated in the rotary distributor, and that comprises at least one bore configured to transport the filling product and/or the medium;

at least one filling product line;

a first connection disposed on a lower end face of the distributor shaft that is configured to connect the at least one filling valve to the distributor shaft by the at least one filling product line, wherein the first connection is oriented in a direction of an axis of rotation of the distributor shaft; and a filling product bowl disposed on the stationary plant section, wherein the filling product is conveyed to a second connection in the distributor housing via a filling product pipework system.

2. The device of claim 1, wherein the at least one filling product line is disposed on the lower end face of the distributor shaft.

3. The device of claim 1, wherein the at least one filling product line comprises a flow meter.

4. The device of claim 1, further comprising a distributor plate disposed on the lower end face of the distributor shaft.

5. The device of claim 4, wherein the distributor plate comprises at least one distribution chamber.

6. The device of claim 5, further comprising a medium line, and wherein the medium line is attached to the at least one distribution chamber.

7. The device of claim 1, wherein the second connection is disposed in an end face of the distributor housing.

8. The device of claim 7, wherein the second connection discharges the filling product into a distribution space that is disposed between an upper end face of the distributor shaft and the distributor housing.

9. The device of claim 8, wherein an upper portion of the distribution space slopes upwards to the second connection.

10. The device of claim 8, wherein the distribution space is in communication with at least one bore.

11. The device of claim 10, wherein the at least one bore extends in a direction of the axis of rotation of the distributor shaft.

12. The device of claim 1, wherein the at least one filling product line comprises a plurality of filling product lines, and wherein the at least one filling valve comprises a plurality of filling valves, and each filling valve is connected to the distributor shaft via a separate filling product line.

13. The device of claim 1, further comprising at least one medium line, and wherein the rotating plant section comprises a ring line and the at least one medium line provides fluid communication between the at least one bore and the ring line.

14. A device for filling containers with a filling product, comprising:

a stationary plant section;

a rotating plant section that rotates in relation to the stationary plant section, and that comprises at least one filling valve;

a rotary distributor configured to transfer the filling product and/or a medium from the stationary plant section to the rotating plant section;

wherein the rotary distributor comprises:

a distributor housing disposed on the stationary plant section, and a distributor shaft disposed on the rotating plant section that is at least partially accommodated in the rotary distributor, and that comprises at least one bore configured to transport the filling product and/or the medium;

a filling product line disposed on a lower end face of the distributor shaft;

a medium line disposed on the lower end face of the distributor shaft;

a first connection disposed on the lower end face of the distributor shaft that is configured to connect the at least one filling valve to the distributor shaft by the filling product line, wherein the first connection is oriented in a direction of an axis of rotation of the distributor shaft; and a filling product bowl disposed on the stationary plant section, wherein the filling product is conveyed to a second connection in the distributor housing via a fillin product pipework system.

15. The device of claim 14, further comprising a distributor plate disposed on the lower end face of the distributor shaft, wherein the distributor plate comprises a distribution chamber, and the filling product line and the medium line are attached to the distribution chamber.

16. The device of claim 14, wherein the rotating plant section comprises a ring line, and the medium line is in fluid communication with the at least one bore and the ring line.

17. The device of claim 1, wherein the rotating plant section comprises a ring line, and the medium line is in fluid communication with the at least one bore and the ring line.

* * * * *